US006868774B2

(12) United States Patent
McCollough et al.

(10) Patent No.: US 6,868,774 B2
(45) Date of Patent: Mar. 22, 2005

(54) SHAFT COUPLING AND SHIFTING MECHANISM FOR PNEUMATIC PUMP

(75) Inventors: Mark Wayne McCollough, Amherst, OH (US); Jim Bachman, Lorain, OH (US); Anna Gilbert, North Olmsted, OH (US)

(73) Assignee: Nordson Corporation, Westlake, OH (US)

( * ) Notice: Subject to any disclaimer, the term of this patent is extended or adjusted under 35 U.S.C. 154(b) by 52 days.

(21) Appl. No.: 10/265,178

(22) Filed: Oct. 5, 2002

(65) Prior Publication Data

US 2003/0068241 A1 Apr. 10, 2003

Related U.S. Application Data

(60) Provisional application No. 60/327,394, filed on Oct. 5, 2001, and provisional application No. 60/327,534, filed on Oct. 5, 2001.

(51) Int. Cl.[7] ..... F01B 29/00

(52) U.S. Cl. ..... 92/128; 92/138; 403/300

(58) Field of Search ..... 92/128, 129, 138; 403/300, 301, 302, 305, 306, 309, 310, 313

(56) References Cited

U.S. PATENT DOCUMENTS

| | | | | | |
|---|---|---|---|---|---|
| 2,557,472 | A | * | 6/1951 | Rulon | 403/313 |
| 3,282,167 | A | | 11/1966 | McKenzie | |
| 3,424,092 | A | | 1/1969 | Hortvet et al. | |
| 4,159,132 | A | * | 6/1979 | Hitz | 285/39 |
| 4,160,626 | A | | 7/1979 | Bell | |
| 4,494,415 | A | * | 1/1985 | Elliston | 92/147 |
| 4,719,845 | A | | 1/1988 | Dugan | |
| 5,131,632 | A | | 7/1992 | Olson | |
| 5,154,532 | A | * | 10/1992 | Schaefer et al. | 92/129 |
| 5,261,449 | A | * | 11/1993 | Smetters | 403/310 |
| 5,275,538 | A | | 1/1994 | Paliwoda et al. | |
| 5,312,233 | A | * | 5/1994 | Tanny et al. | 417/316 |
| 5,482,432 | A | | 1/1996 | Paliwoda et al. | |
| 5,688,067 | A | * | 11/1997 | Straub | 403/305 |
| 6,095,772 | A | | 8/2000 | Ramey et al. | |
| 6,123,008 | A | | 9/2000 | Scherer | |
| 6,164,188 | A | * | 12/2000 | Miser | 92/129 |
| 6,212,997 | B1 | | 4/2001 | McCollough et al. | |

FOREIGN PATENT DOCUMENTS

| | | |
|---|---|---|
| DE | 1264956 | 3/1968 |
| DE | 1942247 | 3/1971 |
| DE | 19860466 C1 | 6/2000 |
| EP | 0315264 | 5/1989 |

OTHER PUBLICATIONS

Nordson 180D–360D Series High–Volume Pumps Brochure (date: Jul. 1996).
DUR O LOK™ (BETE) Catalog (date: not available).
104512F Nordson Manual (date: Nov. 1998).

* cited by examiner

*Primary Examiner*—Thomas E. Lazo
(74) *Attorney, Agent, or Firm*—Calfee, Halter & Griswold LLP

(57) ABSTRACT

Fluid pump assembly driven by a reciprocating piston, having an improved coupling between a driving shaft and a driven shaft and a fast-shifting switching mechanism for changing the direction of movement of the piston.

20 Claims, 12 Drawing Sheets

SHAFT COUPLING AND SHIFTING MECHANISM FOR PNEUMATIC PUMP

RELATED APPLICATIONS

This application claims the benefit of U.S. Provisional patent application Ser. Nos. 60/327,394 and 60/327,534, both filed on Oct. 5, 2001, the entire disclosures of which are fully incorporated herein by reference.

FIELD OF THE INVENTION

The invention relates generally to a fluid pump assembly. More particularly, the invention relates to a coupling mechanism between a driving shaft and a driven shaft which permits quick connection and disconnection of the shafts, while at the same time maintains proper connection during use. The invention further relates to a fast acting shifting mechanism for a piston-driven pneumatic pump.

BACKGROUND OF THE INVENTION

Fluid pump assemblies are well known in the art, and have various applications. One such application is to apply a liquid coating to an article, such that after application the liquid hardens and forms a protective or aesthetic layer on top of the article. Commonly paint is applied to an article in this manner through use of a brush or spray gun. Fluid pump assemblies provide the necessary pressure for the liquid to be sprayed, or otherwise moved through a system.

One such fluid pump assembly is disclosed in U.S. Pat. No. 6,212,997 B1, the disclosure of which is fully incorporated herein by reference. The pump described there includes a piston reciprocated in response to air pressure introduced through an air valve. The air valve operates to alternate delivery of pressurized air, to push the piston and an attached driving rod either up or down. A driven rod is connected at one end to the driving rod and at the other end to a plunger located within a hydraulic housing. The plunger incorporates an internal bore with a pressure ball check near the end which is disposed in the hydraulic housing. As the piston reciprocates, the plunger does also. Through operation of the pressure ball check, the reciprocation forces fluid into and out of the internal bore, under pressure, to be applied elsewhere. In this pump the driven rod is connected to the driving rod by a threaded connection.

Another means for connecting a driving shaft to a driven shaft is disclosed in U.S. Pat. No. 6,164,188. The coupling there comprises a two piece clamp with a recess which receives flanged ends on two reciprocating shafts. What is needed in the art is a reciprocating shaft connection assembly which holds the driving shaft securely against the driven shaft and also ensures the longitudinal axes of the two shafts remain colinear. Such a structure is not present in the prior art.

The driven shaft must be reciprocated by some mechanism, such as a piston reciprocated by air pressure. Known fluid pump assemblies, such as the one illustrated in U.S. Pat. No. 6,212,997 B1, incorporate an over-center spring switch S to switch an air valve between "up" and "down" air pressure configurations. FIG. 1 shows such a spring switch S in more detail. In these assemblies a shift arm is fixed at one end to the driving shaft and at the other end slidably fits over a push rod R, as shown in U.S. Pat. No. 6,212,997 B1. Near the end of a stroke the shift arm encounters a stop on the push rod R, causing the push rod R to move. As shown in FIG. 1, one of two rings $R_1$ and $R_2$ on the push rod R proximate to the air valve V is thereby caused to contact a spring switch S extension E. The spring switch S is thus moved between an "up" and "down" position.

The spring force applied by the over-center spring switch S normally is quite high to achieve fast shifting. Fast shifting is desired because, as the piston changes direction, inevitably there is a short time where the piston is not moving at all. A high spring force keeps this time to a minimum, so that the fluid is pumped at as constant a rate as possible. Otherwise spurting of the fluid being pumped (or "wink") can occur, which is undesired in the application of liquid coatings to articles. The high spring force leads to wear of the parts, especially at the pivot points, and therefore there is a need for part replacement over time. It also can require hardened steel components, and several interconnected parts, both of which increase the cost of the system. Also, a cover is required for the push rod R and spring switch S, to protect against operators being injured by these parts during use.

It is desired therefore desired to provide a fluid pump assembly having a coupling between driving and driven shafts which permits quick connection and disconnection, and also ensures a securely maintained, axially aligned connection between the shafts. Specifically, a need exists for a single shaft coupling mechanism which, by itself, both longitudinally compresses the two shafts together and keeps their longitudinal axes aligned.

It is further desired to provide a fast-shifting switching mechanism which requires fewer wear parts, is easy to maintain and eliminates pinch points to improve operator safety. It is further desired that such a switching mechanism be manufacturable with inexpensive parts.

SUMMARY OF THE PRESENT INVENTION

The present invention is directed to a new fluid pump assembly providing an improved coupling between driving and driven reciprocating shafts. The new coupling operates both to hold the shafts together and to align them along a common longitudinal axis. It further permits a quick connection and disconnection.

The present invention further is directed to an improved fast-shifting switching mechanism for operating an air piston in a fluid pump assembly.

DETAILED DESCRIPTION OF THE INVENTION

With reference to FIGS. 2–5, an embodiment of a reciprocating shaft connection 10 is illustrated. Although the invention is shown and described herein with reference to a specific configuration of the reciprocating shaft connection, this description is intended to be exemplary in nature and should not be construed in a limiting sense. Those skilled in the art will readily appreciate that the present invention may be realized in many different forms and configurations. The present invention in one aspect is more broadly directed to the idea of providing a reciprocating shaft connection that can be easily coupled and uncoupled, and still maintain secure longitudinal alignment of the reciprocating shafts.

Figure 3:
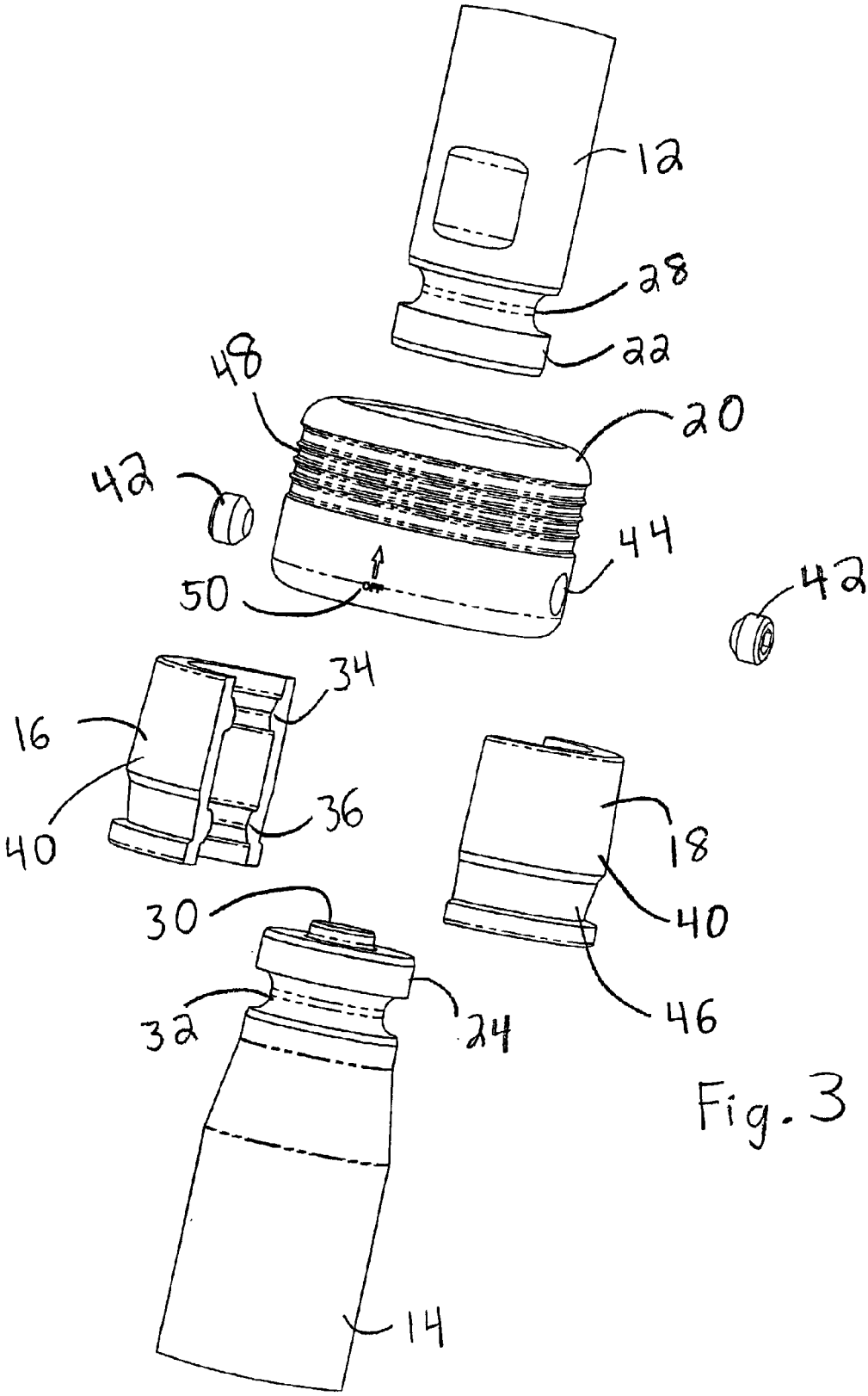
FIG. 3 is a perspective illustration of a reciprocating shaft connection in accordance with the invention, in an uncoupled condition.
Figure 4:
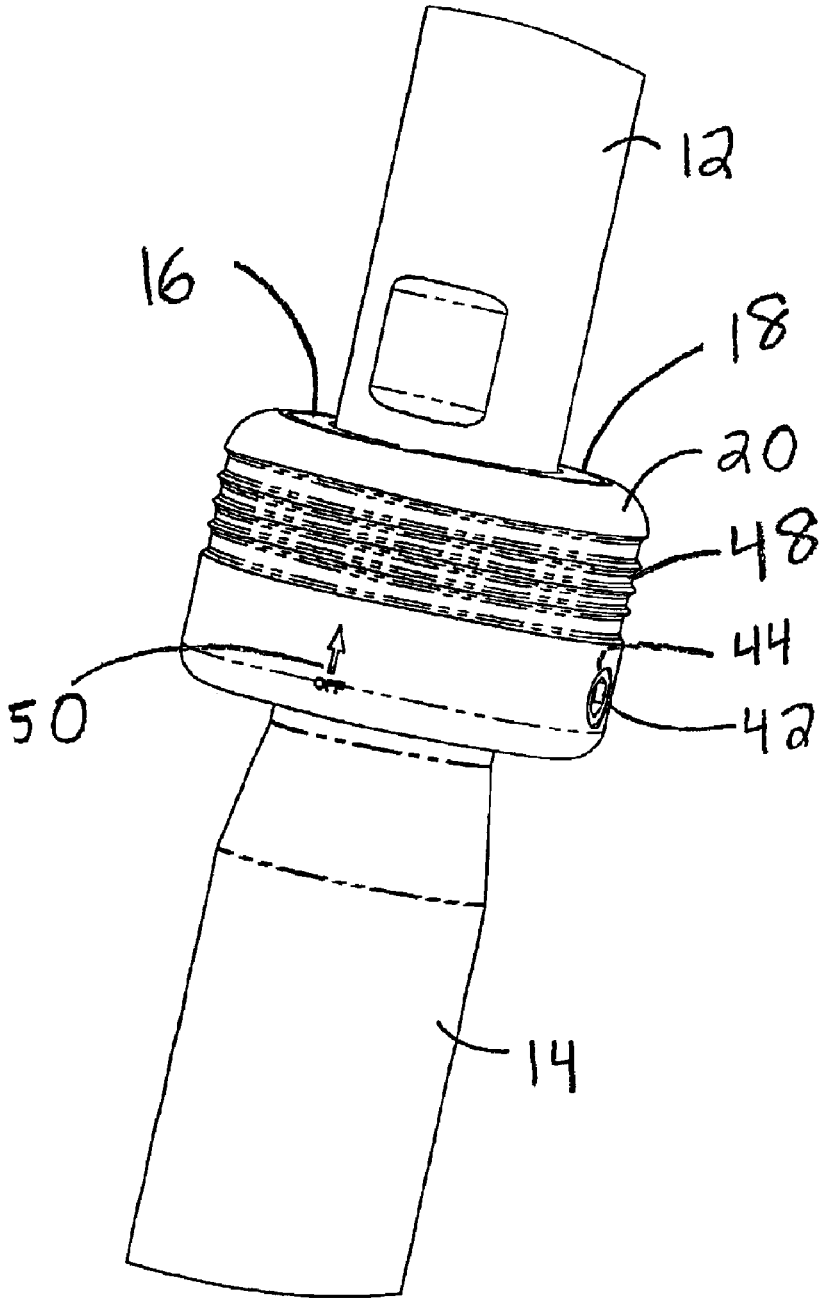
FIG. 4 is a perspective illustration of the reciprocating shaft connection of FIG. 3, in a coupled condition.

FIG. 3 shows the basic components in the reciprocating shaft connection: a first, driving shaft 12; a second, driven shaft 14; two inner collars 16, 18; and an outer collar 20. For better illustration the two shafts 12, 14 are shown oriented at some small angle from a pure vertical disposition, with the driving shaft 12 located above the driven shaft 14. In actual use the two shafts 12, 14 may be vertically disposed, horizontally disposed, or co-linearly disposed at some angle between vertical and horizontal. And, the driven shaft 14 may be located above the driving shaft 12.

Figure 1:
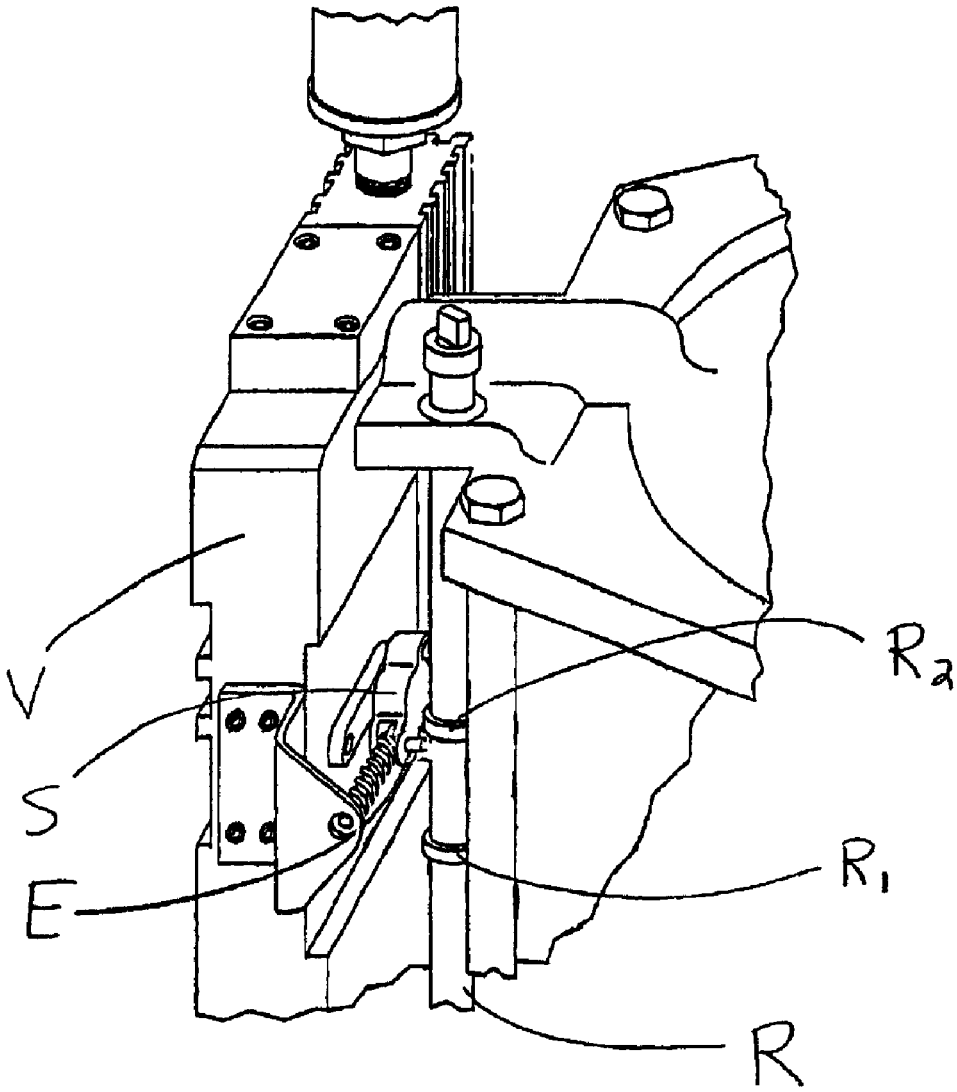
Fig. 1 Prior Art
FIG. 1 shows a spring switch S, as known in the art.
Figure 2:
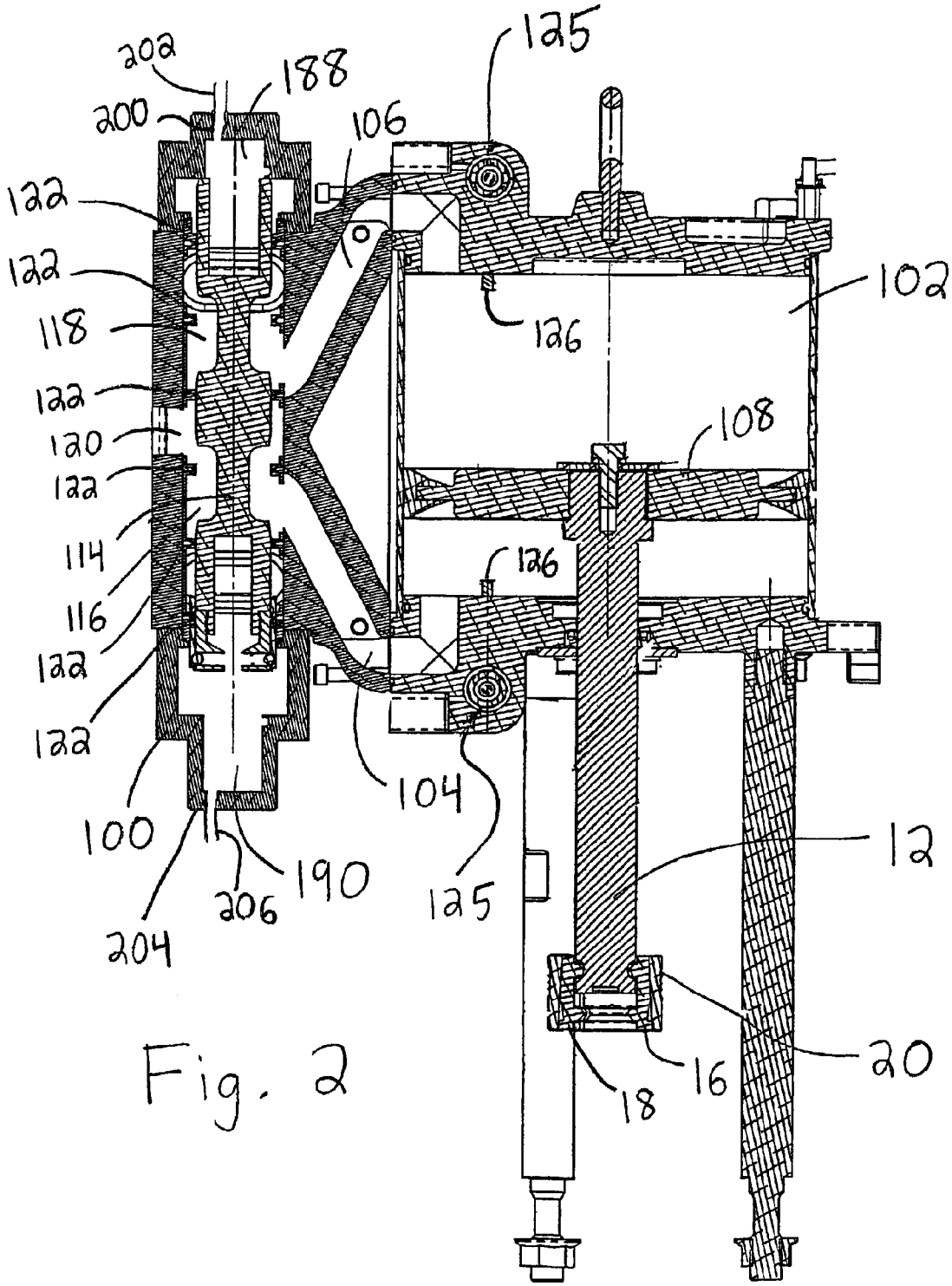
FIG. 2 shows the environment within which the invention is preferably utilized.

FIG. 2 shows the driving shaft 12 connected to the air motor of the present invention. Through the coupling members 16, 18, 20 described in more detail below, driving shaft 12 is preferably connected to a driven shaft for a paint pump such as driven shaft 22 in U.S. Pat. No. 6,212,997 B1 which is hereby incorporated by reference in its entirety.

The driving shaft 12 is operatively connected at one end to the air motor of the present invention as noted. This air motor, later described in detail, reciprocates the driving shaft 12. Shaft 12 is referred to herein as the driving shaft 12 because it causes the driven shaft 14 to reciprocate. With respect to the illustrated driving assembly, of course, the driving shaft 12 is a "driven" shaft. Similarly, the driven shaft 14 is a "driving" shaft with respect to the fluid being driven by the fluid pump assembly.

The driving shaft 12 is coupled at a coupled end 22 to a coupled end 24 of the driven shaft 14. The coupled end 22 of the driving shaft 12 has a tab aperture 26 (shown in FIG. 5), and the coupled end 24 of the driven shaft 14 has a tab 30. The tab aperture 26 and tab 30 may have any desired shape, such as a circle (as shown in the Figures), a square, a triangle, and the like. It is preferred that they have a circular shape. When the two shafts 12, 14 are coupled, the tab 30 projects into the tab aperture 26. This aids in keeping the shafts 12, 14 aligned during the coupling operation. Preferably, a gap 31 (shown in FIG. 5) is left between the top of the tab 30 and the bottom of the tab aperture 26. In that way the load is borne where the annular portions of the coupled ends 22, 24 abut around the tab aperture 26 and tab 30. To prevent wear and help maintain shaft alignment, those annular portions should be substantially flat and substantially parallel to each other.

In addition, if the tab aperture 26 and the tab 30 are designed to provide a tight fit, they will further help orient the two shafts 12, 14 along co-linear axes during reciprocation of the shafts 12, 14. For example, the tab aperture 26 and tab 30 may be made circular in shape with the radius of the aperture 26 being just slightly larger than the radius of the tab 30. Alternatively, the coupled end 22 of the driving shaft 12 may include a tab 30, with the coupled end 24 of the driven shaft 14 including a tab aperture 26.

Figure 5:
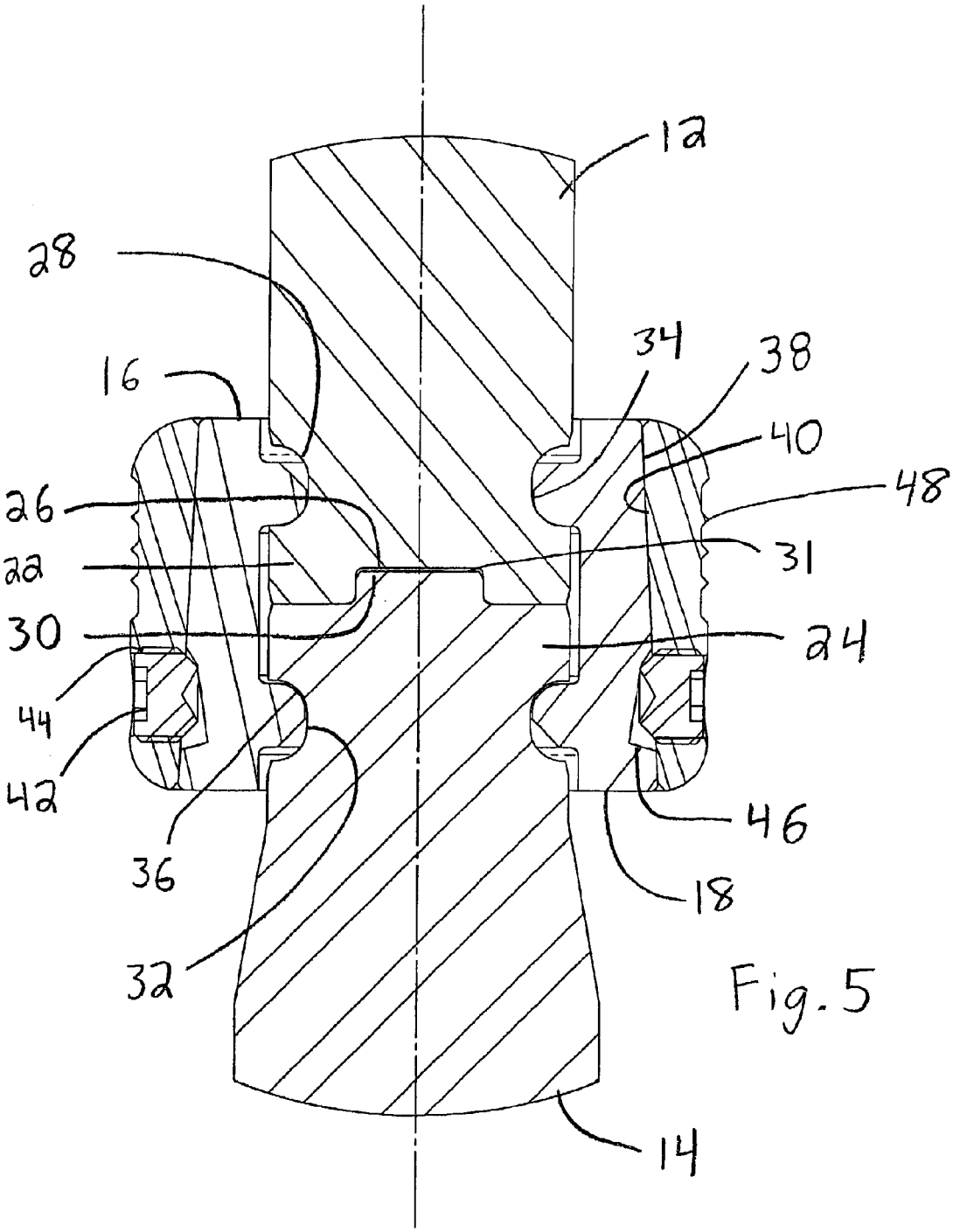
FIG. 5 is a cross-sectional view of the reciprocating shaft connection of FIG. 4, in a coupled condition.

As best shown in FIGS. 3 and 5, the coupled end 22 of the driving shaft 12 is connected to the coupled end 24 of the driven shaft 14 by inner collars 16, 18 and an outer collar 20. First the outer collar 20 is placed over the driving shaft 12, momentarily spaced away from the coupled end 22, and then the coupled ends 22, 24 are brought together. The inner collars 16, 18 are placed around the two shafts 12, 14. Two or more inner collars may be used; the Figures show two inner collars 16, 18 as a preferred embodiment. The inner collars need not be identically sized, so that for example a first inner collar may cover 180° of the circumference of the shafts 12, 14, a second may cover 90° and a third may cover the remaining 90°. Identically sized collars are preferred because they reduce the number of parts which must be made and used. Additionally, the inner collars need not completely surround the circumference of the two shafts 12, 14. However, complete coverage is preferred so that the reciprocating force may be distributed over as wide an area as possible, thus minimizing wear of the various parts.

The inner collars 16, 18 hold the shafts 12, 14 together via mating projections and detents. As shown in the Figures, for example, the coupled ends 22, 24 respectively have ring detents 28, 32 and the two inner collars 16, 18 each have two ring projections 34, 36. Ring projections 34 fit into ring detent 28, while ring projections 36 fit into ring detent 32. Alternatively, the coupled ends 22, 24 may have ring projections which fit into ring detents in the inner collars. Further, in place of rings which circumferentially extending in an unbroken fashion, more discrete projection/detent combinations may be used. For example, each inner collar 16, 18 may include two or more circumferentially spaced-apart projections which fit into mating detents in the shafts 12, 14, sized to provide a tight fit. This would prevent relative rotation between the reciprocating shafts and the inner collar members, which may be useful for some applications.

After the inner collars 16, 18 have been properly placed over the shafts 12, 14, the outer collar 20 is moved from its momentary position (over the driving shaft 12 spaced away from the coupled end 22) to a rest position covering the two inner collars 16, 18. The outer collar 20 preferably has a sloping internal surface 38 corresponding to a sloping external surface 40 of the inner collars 16, 18. This creates a compressive force holding the inner collars 16, 18 against the reciprocating shafts 12, 14.

In many uses friction created along the sloping surfaces 38, 40 may serve to prevent the outer collar 20 from slipping off of the inner collars 16, 18. The outer collar 20 may, however, be more forcefully secured to the inner collars 16, 18 by one or more collar fasteners. Collar fasteners may be useful merely for added safety or where reciprocation is especially vigorous. Preferably the inner collars 16, 18 fit tightly enough that any collar fastener is relied upon only to hold the outer collar 20 in place, not to transmit reciprocating force from the driving shaft 12 to the driven shaft 14. The collar fastener may be, for example, an elastomeric snap ring or a clip placed around the driving shaft 12 on top of the outer collar 20; or a pin may be housed in the diving shaft 12 and disposed just above the outer collar 20, or receivable in a pin hole within the outer collar 20.

One or more set screws 42, as illustrated in the Figures, are preferably used as a collar fastener. The set screws 42 may extend through threaded screw apertures 44 in the outer collar 20 (threading not shown in the Figures). Preferably, but not necessarily, the set screws 42 are received in a recess of the inner collars 16, 18. Such a recess may comprise an outer ring detent 46, as shown in the Figures, or a series of circumferentially spaced external apertures in the inner collars 16, 18 (one for each set screw 42). Interference between the set screws 42 and the ring detents 46 or external apertures in the inner collars 16, 18 prevent the outer collar 20 from slipping off the inner collars 16, 18.

The external surface of the outer collar 20 exhibits several ridges 48. These ridges 48 permit a user to obtain a better grip in the outer collar 20, either for coupling or uncoupling the shaft connection. This can be useful, for example, because after use over a period of time the outer collar 20 tends to stick to the inner collars 16, 18. The ridges 48 provide a convenient place to grip with hands or to nudge with a screwdriver or other tool so that the outer collar 20 will slip off the inner collars 16, 18. An indicator 50 may be placed on the outer collar 20, or on one of the shafts 12, 14, to show in what direction the outer collar 20 should be moved to slip it off the inner collars 16, 18.

Materials choice for the shafts and collar is, of course, dictated by the loads borne by these components. In the Applicants' intended use the shafts will be bearing about 10,000 pounds of force. At that level of force, steel may appropriately be used to make the various components. Type 303 steel may be used to help prevent environmental effects on the components. The Applicants have found Type 4140 steel sufficient for the inner collar 16, 18 members and Type 303 steel sufficient for the outer collar 20. For applications where less force is being transmitted, use of plastic may be appropriate for these components.

As best seen in FIG. 5, this coupling creates a radial surface as an interface between the inner collars 16, 18 and the shafts 12, 14. Specifically, the bearing surfaces of ring projections 34, 36 and ring detents 28, 32 create an arcuate interface between these elements. Thus sloping interface 38, 40, serves two purposes at the same time. It both holds the coupled ends 22, 24 together and also aligns the shafts 16, 18 so that their longitudinal axes are substantially co-linear.

As previously mentioned, some mechanism must drive the reciprocation of the two shafts 12, 14. One such mechanism is a piston driven by air pressure, shown in FIG. 2 and in FIG. 6 in cross section. A main valve 100 controls whether pressurized air enters the piston chamber 102 via an lower passageway 104 or an upper passageway 106. As used herein, "up", "down" and similar relational terms are used for convenient labels when referring to the embodiments illustrated in the Figures. It will be appreciated that, in real use, the illustrated embodiment could in effect be turned upside down if it is desired to drive the driving shaft 12 from below instead of from on top as illustrated.

When air enters via the lower passageway 104 the piston 108 is pushed upward, and air displaced from the upper portion of the piston chamber 102 exits from an upper exit port (not shown in the Figures). When air enters via the upper passageway 106 the piston 108 is pushed downward, and air displaced from the lower portion of the piston chamber 102 exits from lower exit port (not shown in the Figures). As the piston 108 reciprocates, so does the driving shaft 12.

The main valve 100 operates in the following manner. A generally cylindrical valve shaft 114 with two reduced diameter sections 116, 118 moves up and down within the main valve 100. The valve shaft 114 is shown in an up position in FIG. 6. Pressurized air enters the main valve 100 via an inlet 120. Intermediate o-rings 122 seal against the outer circumference of the valve shaft 114 to direct the pressurized air either through the lower annular recess 116 and into the lower passageway 104, or through the upper annular recess 118 and into the upper passageway 106. In this way, switching of the main valve 100 proceeds by moving the valve shaft 114 up and down.

Figure 6:
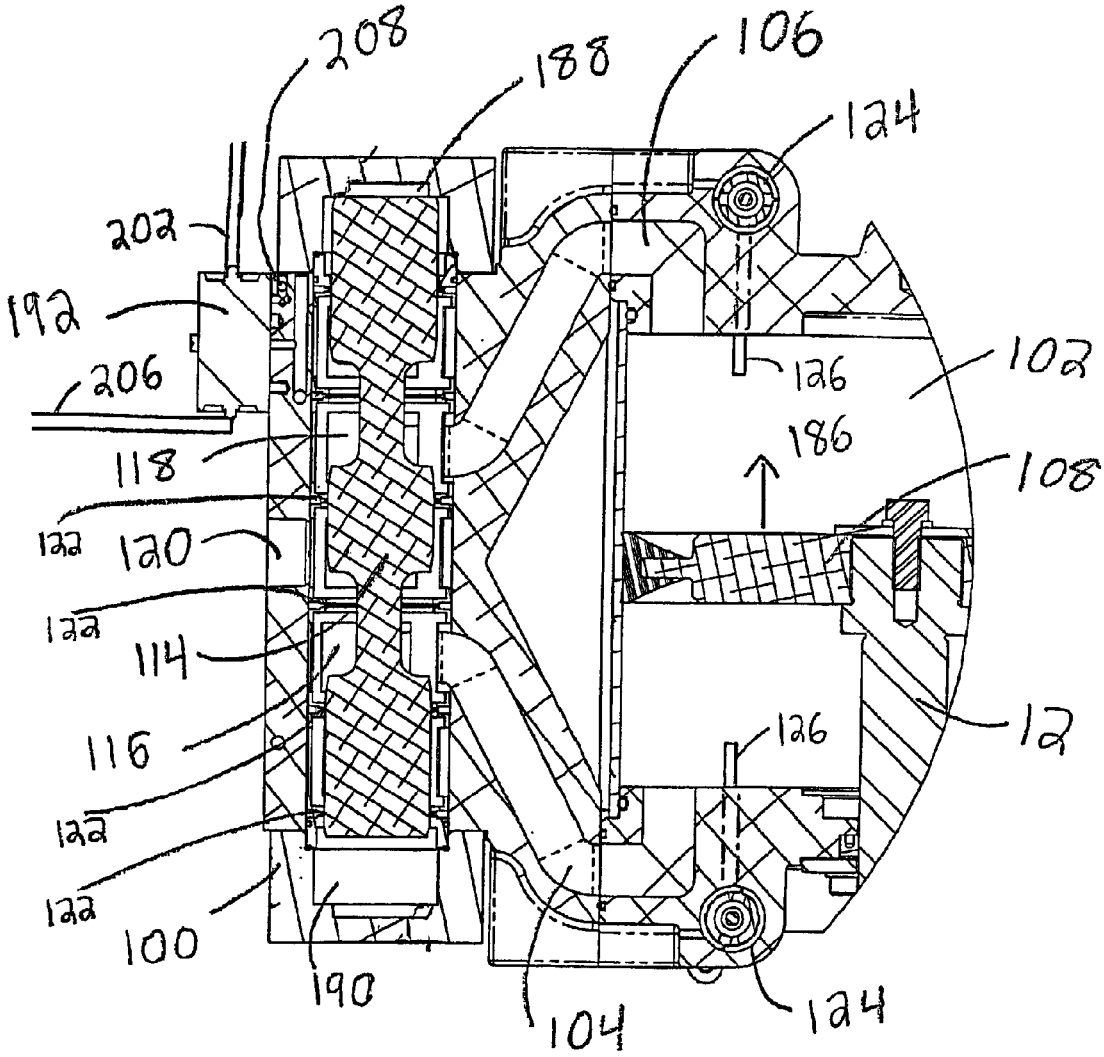
FIG. 6 is a cross-sectional view of a piston driven by air pressure.
Figure 7A:
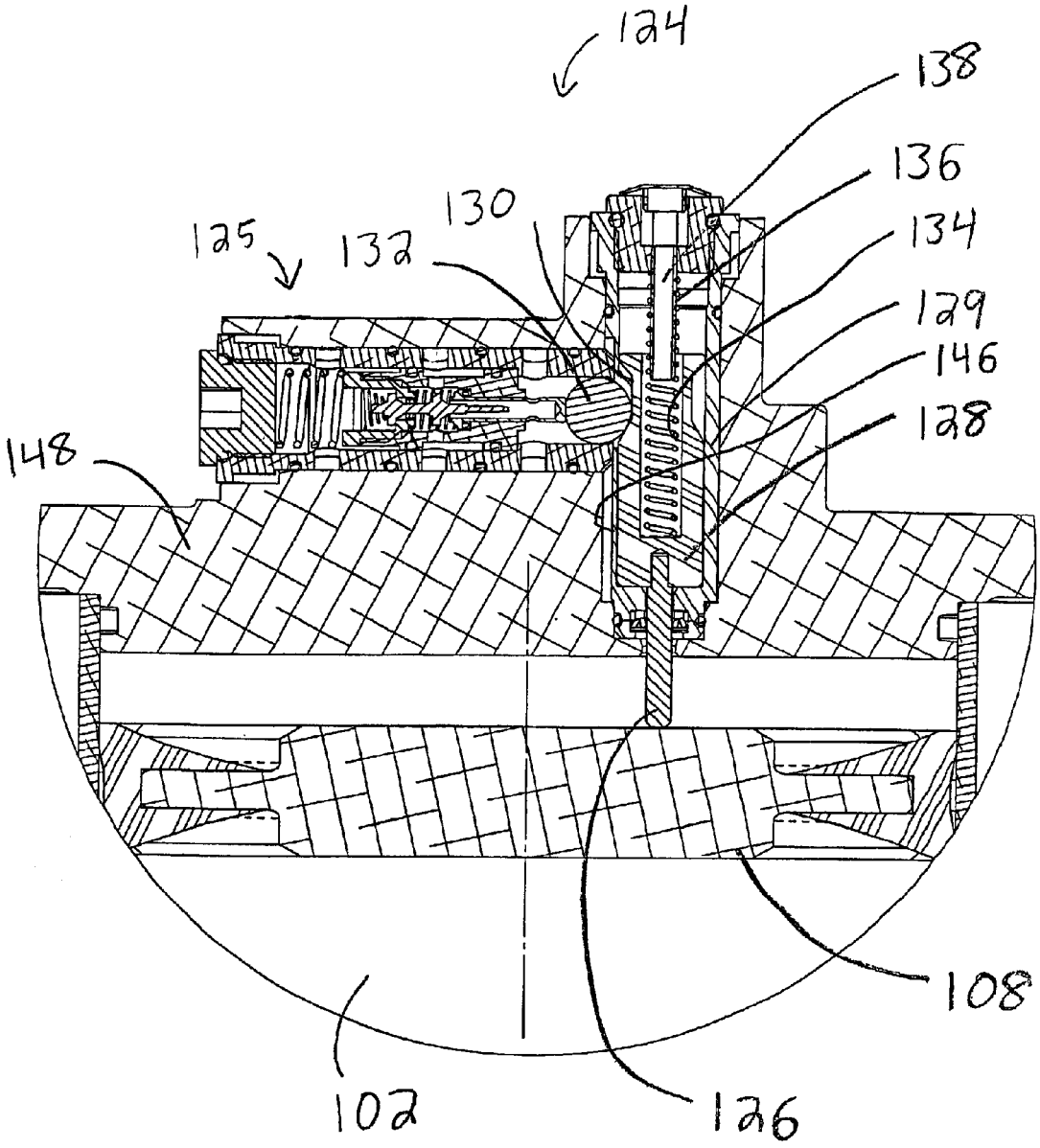
FIGS. 7A–7B is a cross-sectional view of a switch in an unactuated position.
Figure 7B:
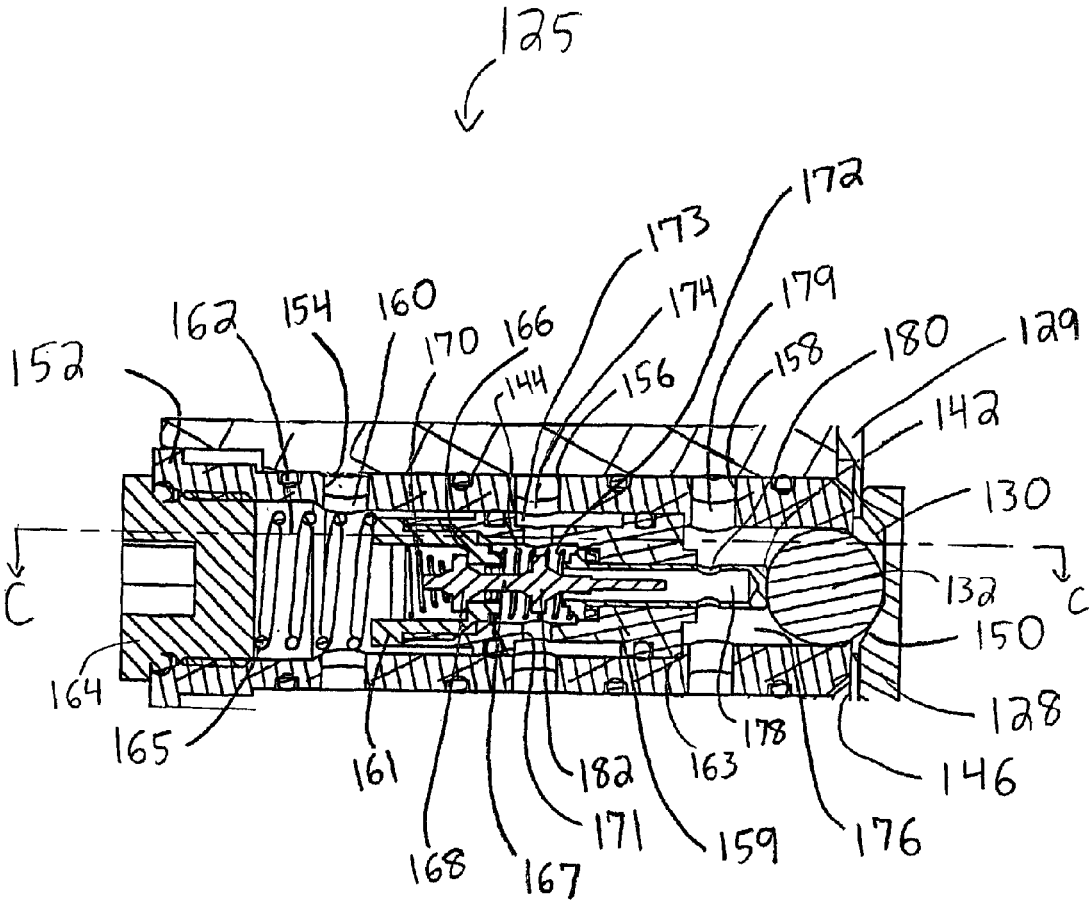
Figure 7C:
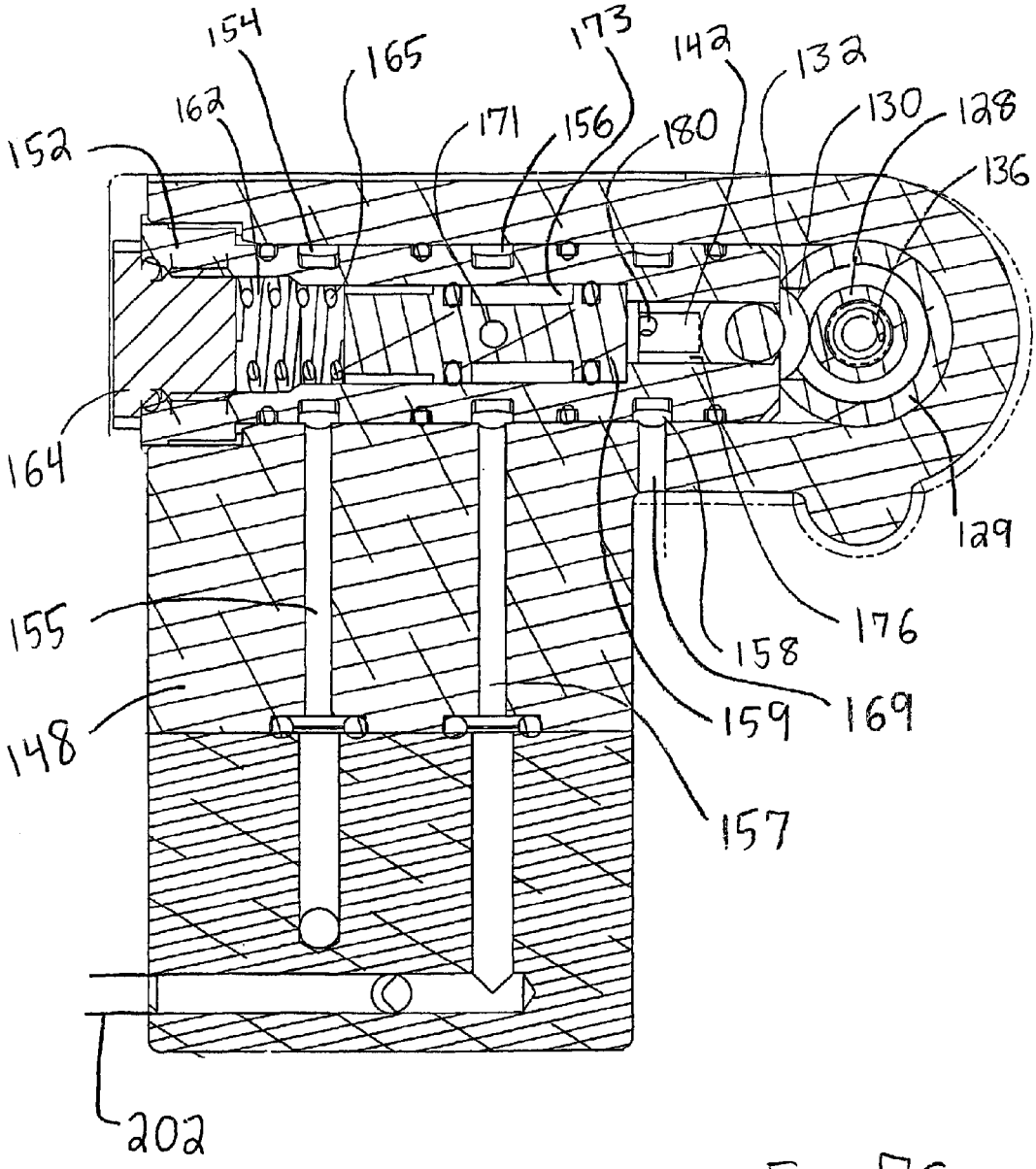
FIG. 7C is a cross-sectional view of a switch in an unactuated position, taken along section C—C shown in FIG. 7B, additionally showing air passageways leading from the switch.
Figure 8A:
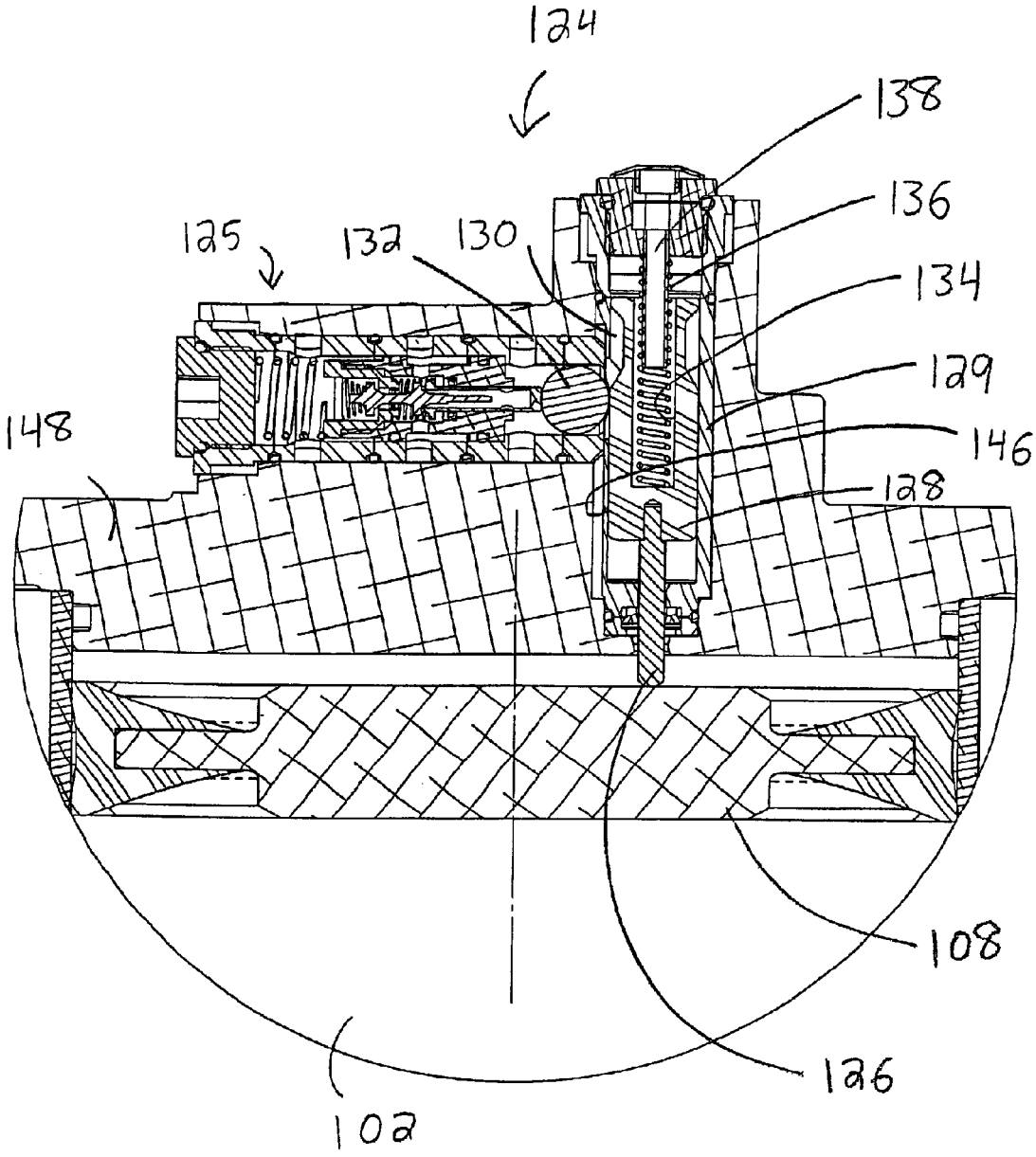
FIGS. 8A–8B is a cross-sectional view of a switch in an actuated position.
Figure 8B:
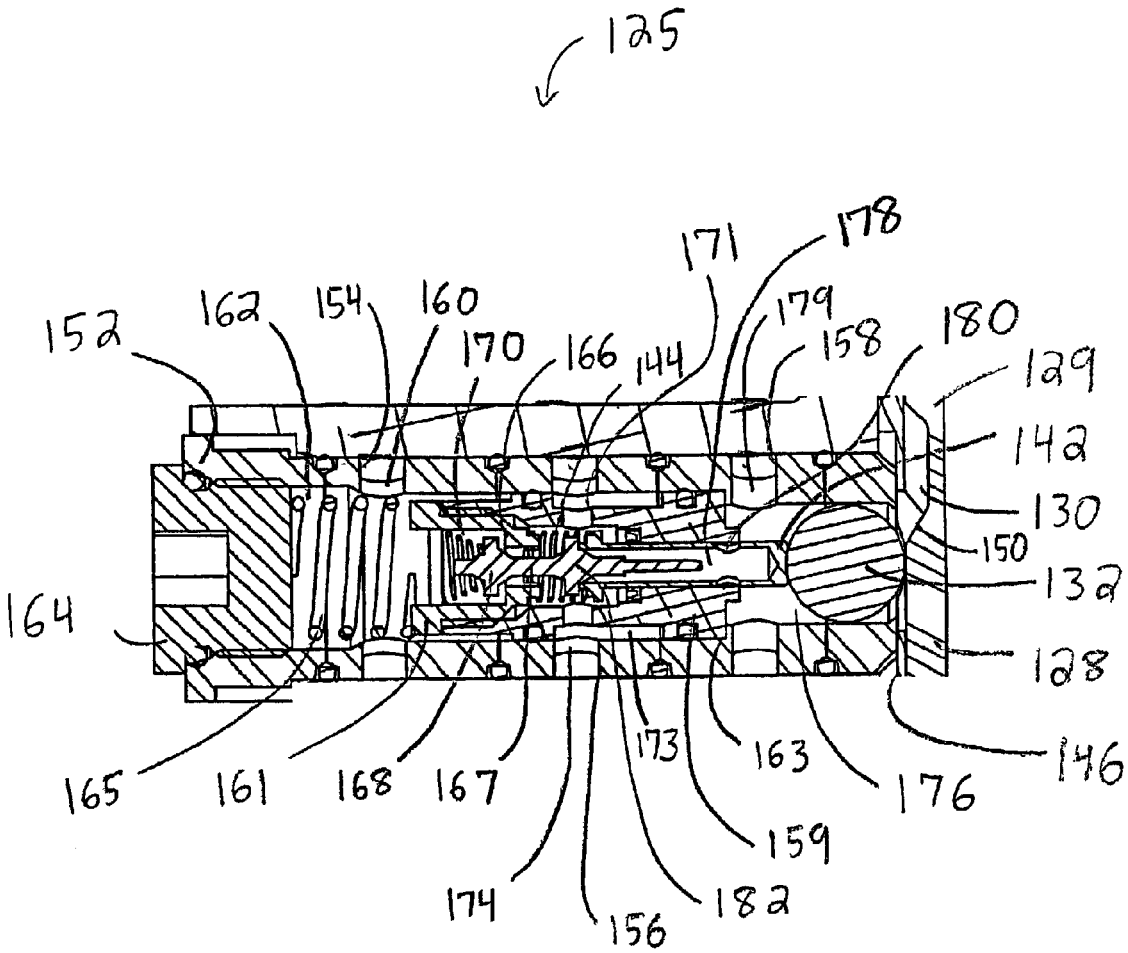

In the preferred embodiment of the present invention, that switching is achieved with two switches 124. One switch 124 is disposed at the top of the piston chamber 102, as shown in FIGS. 6–8, the other at the bottom of the piston chamber 102. FIGS. 7A, 7B, 7C, 8A and 8B only illustrate the switch 124 at the top of the piston chamber 102 because it operates in the same fashion as the switch 124 at the bottom of the piston chamber 102. Generally, the switch comprises a vertical plunger 128 and a three-way valve 125.

As the piston 108 nears the top of its up stroke, it encounters an actuator pin 126 in the switch 124. FIGS. 7A–7C illustrates the switch 124 in cross section at the moment the piston 108 first contacts the actuator pin 126. The actuator pin 126 is either integral with, or fixedly attached to (such as by threading), a vertical plunger 128 housed within a plunger housing 129. The vertical plunger 128 has a recess 130 for receiving a ball 132 of the three-way valve 125, as further discussed below. The vertical plunger also has an upper bore 134, fitted within which is a spring alignment rod 138 surrounded by a spring 136. The spring 136 biases the vertical plunger 128 in the downward direction. Various o-rings seal against air passage in or out of the piston chamber 12 through the switch 124. The upward-moving piston 102 vertically displaces the actuator pin 126 against the bias of the spring 136, actuating the switch 124.

Before actuation, as shown in FIGS. 7A–7C, the ball 132 is pressed within the recess 130 of the vertical plunger 128 by a ball pin 142 acting under the bias of a ball spring 144. The plunger housing 129 preferably is generally cylindrical in shape, except that a flattened region 146 is formed in the side facing the three-way valve 125. The flattened region 146 aids alignment of the three-way valve 125 with respect to the plunger housing 129, including proper alignment of the ball 132 within the recess 130. It also permits removal of the plunger housing 129 from the upper wall 148 of the piston chamber 102 without first having to remove the three-way valve 125.

FIGS. 8A–8B shows the switch 124 in an actuated position. As the vertical plunger 128 is forced upwards by the piston 108, the ball 132 is horizontally displaced against the bias of the ball spring 144 to reach the position shown in FIGS. 8A–8B. Ideally, the lower surface 150 of the vertical plunger 128 defining the recess 130 should be angled so that it touches the outer surface of the ball 132 at all times (before, during, and after actuation). This maximizes the speed of the switch 124. The exact angle of the lower surface 150 is determined by the amount of horizontal ball 132 displacement required to open the three-way valve 125. The principal function of the recess 130 is to force horizontal displacement of the ball 132, so it is not necessary for the recess 130 to extend all the way around the vertical plunger 128 as illustrated. This annular recess is, nonetheless, preferred because it simplifies manufacture and assembly.

The horizontal displacement of the ball 132 opens a three way valve 125. As discussed above, it is desirable for this actuation to be as fast as possible to avoid spurting of the pumped fluid. This means that, in this embodiment, it is desirable for a very small vertical movement of the vertical plunger 128 to result quickly in horizontal displacement of the ball 132 (and therefore opening of the three-way valve 125). This is more easily accomplished if the vertical plunger 128 has an outer diameter which is about equal to the diameter of the ball 132, or larger.

Any three-way valve, actuated by the ball 132, will achieve the aims of the present invention. The three-way valve 125 described here works well. The external configuration of the valve housing 152 is generally cylindrical in shape with three annular recesses: an input annulus 154, a delivery annulus 156, and an exhaust annulus 158. An internal, cylindrical bore in the valve housing 152 holds a transfer body 159 with an end cap 161 threaded into one side (the end cap 161 may alternatively be made integral with the transfer body 159). The transfer body 159 is held in place against a counterbore 163 within the valve housing 152 by a holding spring 165 and a closure cap 164. The closure cap 164 may be held in place within the three-way valve 125 with adhesive, a threading attachment, a tight fight, or the like. Housed within the transfer body 159 is a transfer shaft 167 with a transfer plug 168 and an exhaust plug 182.

Pressurized air is supplied to the input annulus 154 through input passageway 155 in the upper wall 148. One or more input holes 160 permit the pressurized air to pass from the input annulus 154 to an input chamber 162 within the valve housing 152, between the closure cap 164 and the transfer body 159. In the unactuated position of FIGS. 7A–7C, a transfer port 166 in the transfer body 159 is closed by a transfer plug 168, biased closed by a transfer spring 170. Thus, with the three-way valve 125 in a closed position, the pressurized air is trapped within the input chamber 162.

The transfer port 166 leads to a delivery chamber 172 within the transfer body 159. One or more transfer holes 171 lead from the delivery chamber 172 to an external annulus 173 of the transfer body 159. From there one or more delivery holes 174 permit air to transfer between the delivery chamber 172 and the delivery annulus 156. Air within the delivery annulus 156 can travel to the main valve 100 via delivery passageways 157 in the upper wall 148, as further discussed below.

When the three-way valve 125 is in the unactuated position of FIGS. 7A–7C, air may freely communicate between the delivery chamber 172 and an exhaust chamber 176 through an exhaust port 178 in the transfer body 159. One or more exhaust holes 179 lead from the exhaust chamber 176 to the exhaust annulus 158, and an exhaust passageway 169 in the upper wall 148 leads from there to the atmosphere. The exhaust port 178 is formed as a central bore, with one or more exit holes 180 (two are shown in the Figures), within the ball pin 142. The exhaust port 178 may be closed by an exhaust plug 182 disposed within the delivery chamber 172, but the exhaust port 178 remains open when the three-way valve 125 is closed. Thus, with the three-way valve 125 in a closed position of FIGS. 7A–7C, air is free to travel between the delivery chamber 172 and the exhaust chamber 176.

The three-way valve 125 is opened when the ball 132 is forced back by the vertical plunger 128, to the position shown in FIGS. 8A–8B. This forces the ball pin 142 to move against the bias of the ball spring 144, until the ball pin 142 abuts the exhaust plug 182, thus closing the exhaust port 178. At approximately the same time, the exit holes 180 are closed as the ball pin 142 is pushed back through an internal bore in the transfer body 159. At this point, the exhaust chamber 176 is sealed away from the delivery chamber 172, which is turn is still sealed away from the input chamber 160.

Further movement of the ball 132 causes the ball pin 142 to push the exhaust plug 182, and therefore moves the transfer shaft 167 against the bias of the transfer spring 170. In this way the transfer plug 168 is forced away from the transfer port 166, so that pressurized air is free to move from the input chamber 162 to the delivery chamber 172. Because the exhaust chamber 176 is sealed away from the delivery chamber 172, the air is forced out of the three-way valve 125 via the delivery annulus 156.

The three way valve 125 operates in the following manner. In the closed position of FIGS. 7A–7C, the pressurized air supplied via the input annulus 154 is held within the input chamber 162. Further, the delivery annulus 156 is open to the exhaust annulus 158. Because air passageways lead from the delivery annulus 156 to the main valve 100, with the three way valve 125 in the closed position no pressurized air is delivered to the main valve 100. In the open position of FIGS. 8A–8B, by contrast, the pressurized air supplied via input annulus 154 is free to enter the delivery annulus 156. At the same time, the exhaust annulus 158 is sealed off from both the input annulus 154 and the delivery annulus 156. So, in the open position, pressurized air is delivered to the main valve 100 in the following way. Air enters the delivery annulus 156 and flows through delivery passageway 157 into an air line 202. Air line 202 is connected (in FIG. 2) to a bore 200 into the upper chamber 188 in main valve 100. As pressurized air enters chamber 188 it pushes the shaft 114 down in FIG. 2 to divert the air flow into upper passageway 106 to cause air to flow into the top of chamber 102 to reverse the direction of movement of piston 108 to a downward direction in FIG. 2.

Once piston 108 reaches the bottom of its stroke and hits the lower actuator pin 126 in FIG. 2, the lower three-way valve 125 will, in the same manner as has been described above with respect to the upper three-way valve 125, supply pressurized air from the lower three-way valve 125 through an air line 206 which is connected to a bore 204 in FIG. 2. Bore 204 admits pressurized air into lower chamber 190 which, once again, reverses the direction of movement of shaft 114 to move it upwardly in FIG. 2 and reroute the air from upper passage 106 to lower passageway 104. This reverses the direction of movement of piston 108 to move it in an upward direction in FIG. 2 again, to complete the cycle.

Thus, the driving shaft 12 is reciprocated to pump paint through the pump driven by the driven shaft 14 by a completely pneumatic air motor piston shifting system, without the need for a mechanical shifting linkage with a heavy spring. This all pneumatic system provides the advantages described above, namely, fewer wear parts, easier maintenance and greater operator safety.

Although external air lines 202, 204 are shown in the Figures, air could alternatively be routed from three way valves 124 to the main valve 100 entirely through internal passageways disposed in the upper wall 148 and main valve 100.

Ideally, when unactuated, the switches 124 will completely prevent pressurized air being delivered to the upper chamber 188 or lower chamber 190. In practice, an unactuated three way valve 125 may bleed pressurized air out to the main valve 100. Then the valve shaft 114 may be caused to move only partway within the main valve 100, reaching an undesirable middle position. In that position, pressurized air supplied to the inlet 120 may be supplied to both the lower passageway 104 and the upper passageway 106. Thus pressure is equalized in the piston chamber 102, and the pump will stall. The likelihood of such a stall increases with lower piston cycle frequency.

To avoid such stalling, the valve shaft 114 may be more securely held in its upper and lower positions. For example, one may place detents in the valve shaft 114 and spring balls into the walls of the bore in the main valve 100, so that the balls are forced into the detents when the valve shaft 114 is in one of its two proper positions. Pressurized air leaking through the three way valve 125 will be at a lesser pressure than the air delivered when the switch 124 is actuated. So, the spring force behind the ball springs may be calibrated to prevent movement of the valve shaft 114 due to bled air, but permit movement when the switch 124 is activated. This, however, leads to a point of wear in the system—namely, the ball spring and detents.

Figure 9:
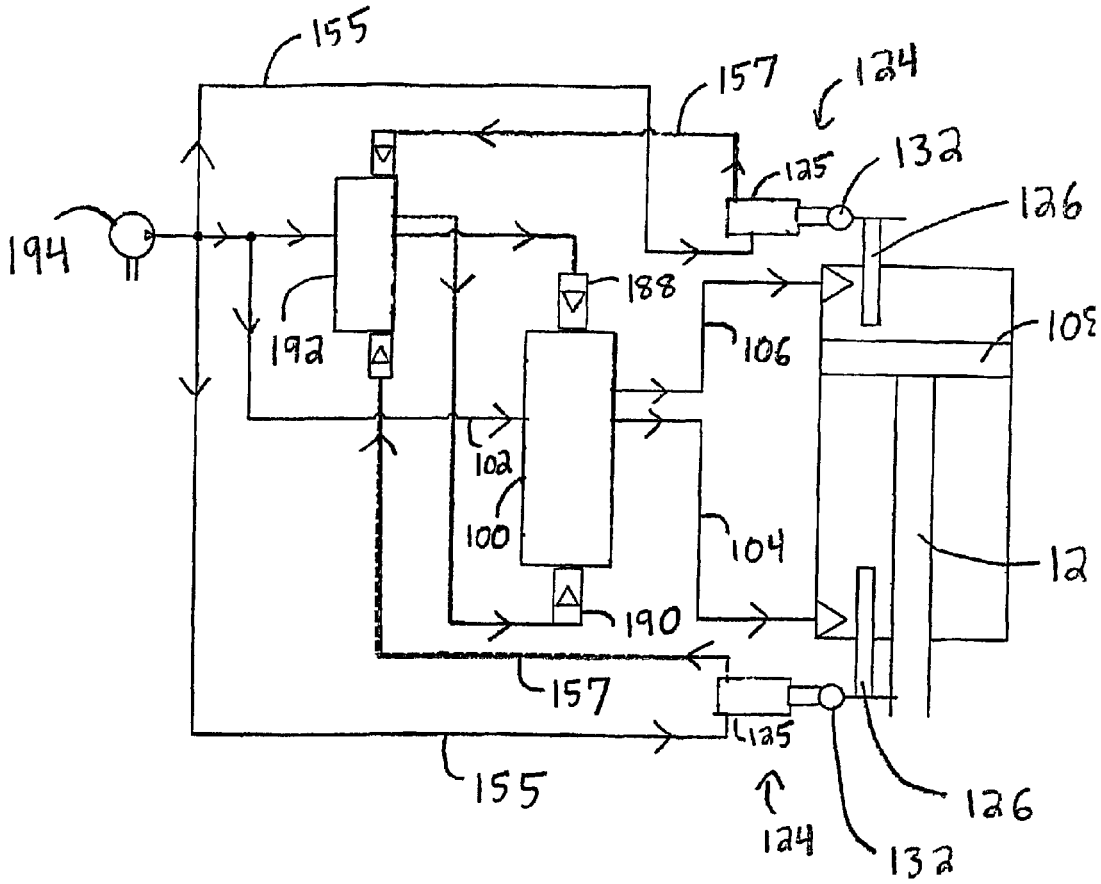
FIG. 9 illustrates a schematic air diagram for a fluid pump system.

Another way to prevent unwanted movement of the valve shaft 114, but without adding a point of wear, is to use a four way, two position valve 192 (FIGS. 6 and 9) disposed in the air path between the switches 124 and the upper chamber 188 and the lower chamber 190. As partially shown in FIG. 6, passages 208 internal to the main valve 100 may lead from the valve 192 to the upper chamber 188 and the lower chamber 190. FIG. 9 illustrates a schematic air diagram for a system incorporating such a four way valve 192, which is readily available as an off-the-shelf product. Arrows indicate in what direction air flows through the various passageways, if it is flowing at all. Pressurized air is supplied from an air compressor 194 to each three way valve 125, the main valve 100 and the four way valve 192.

It is intended that invention not be limited to the particular embodiments and alternative embodiments disclosed as the best mode or preferred mode contemplated for carrying out the invention, but that the invention will include all embodiments falling within the scope of the appended claims.

We claim:

1. A reciprocating shaft connection comprising a first reciprocating shaft having one or more detents at a first connected end, a second reciprocating shaft having one or more detents at a second connected end, a tab on the first connected end and a tab aperture on the second connected end, wherein the tab projects into the tab aperture when the first and second shafts are connected, and a connecting collar for connecting the first and second shafts, wherein the connecting collar has a first projection sized and placed to fit into at least one detent at the first connected end to create a first arcuate interface and a second projection sized and placed to fit into at least one detent on the second connected end to create a second arcuate interface.

2. A reciprocating shaft connection as in claim 1 wherein an outer collar is placed around the connecting collar.

3. A reciprocating shaft connection as in claim 2 further comprising a ridge on an external surface of the outer collar.

4. A reciprocating shaft connection as in claim 3 further comprising an indicator on the external surface of the outer collar to indicate how to remove the outer collar from around the connecting collar.

5. A reciprocating shaft connection as in claim 2 further comprising an aperture in the outer collar and a set screw for insertion into the aperture.

6. A reciprocating shaft connection as in claim 5 further comprising a recess in the connecting collar for receipt of the set screw.

7. A reciprocating shaft connection as in claim 2 further comprising a sloping external surface on the connecting collar and a sloping internal surface on the outer collar, wherein the sloping external surface mates with the sloping internal surface of the outer collar when the first and second shafts are connected.

8. A reciprocating shaft connection as in claim 2 wherein there are two connecting collars.

9. A reciprocating shaft connection as in claim 1 wherein the one or more detents comprise one ring detent and the first and second projections each comprise a ring projection.

10. A reciprocating shaft connection as in claim 1 further comprising a first substantially flat surface on the first connected end and a second substantially flat surface on the second connected end, wherein the first and second substantially flat surfaces are substantially parallel when the first and second shafts are connected.

11. A reciprocating shaft connection as in claim 1 wherein the tab comprises a top and the tab aperture comprises a bottom, and a gap exists between the top and the bottom when the first and second shafts are connected.

12. A reciprocating shaft connection as in claim 1 wherein the first connected end comprises a first substantially flat annular surface surrounding the tab, the second connected end comprises a second substantially flat annular surface surrounding the tab aperture, and the first and second substantially flat annular surfaces are substantially parallel when the first and second shafts are connected.

13. A fluid pump assembly comprising the reciprocating shaft connection of claim 1.

14. A fluid pump assembly comprising a driving reciprocating shaft operatively connected to a driving assembly and having one or more driving detents at a coupled end, and a driven reciprocating shaft having one or more driven detents at a coupled end, the driven shaft being operatively connected to a plunger in a fluid housing;

at least two inner collars, each of which comprises a driving inner projection sized and placed to fit into one or more driving detents to create a driving radial interface, and a driven inner projection sized and placed to fit into one or more driven detents to create a driven radial interface, the inner collars being placed around the driving and driven shafts at their coupled ends; and an outer collar placed around the inner collars.

15. A fluid pump assembly as in claim 14 wherein the driving assembly comprises an air-driven piston assembly.

16. A fluid pump assembly as in claim 15 further comprising a fluid conduit leading from the fluid pump assembly to a spray gun for spraying the fluid pumped by the fluid pump assembly.

17. The fluid pump of claim 14 comprising a tab on the first connected end and a tab aperture on the second connected end, wherein the tab projects into the tab aperture when the first and second shafts are connected.

18. The fluid pump of claim 14 wherein the tab comprises a top and the tab aperture comprises a bottom, and a gap exists between the top and the bottom when the first and second shafts are connected.

19. The fluid pump of claim 14 comprising a sloping external surface on the internal collars and a sloping internal surface on the outer collar, wherein the sloping external surface mates with the sloping internal surface of the outer collar when the first and second shafts are connected.

20. A reciprocating shaft connection comprising a first reciprocating shaft having one or more detents at a first connected end, a second reciprocating shaft having one or more detents at a second connected end, and a connecting collar for connecting the first and second shafts, wherein the connecting collar has a first projection sized and placed to fit into at least one detent at the first connected end to create a first arcuate interface and a second projection sized and placed to fit into at least one detent on the second connected end to create a second arcuate interface, an outer collar placed around the connecting collar, a sloping external surface on the connecting collar and a sloping internal surface on the outer collar, wherein the sloping external surface mates with the sloping internal surface of the outer collar when the first and second shafts are connected.

* * * * *